US008505353B2

(12) United States Patent
Park et al.

(10) Patent No.: US 8,505,353 B2
(45) Date of Patent: Aug. 13, 2013

(54) METHOD OF MANUFACTURING MAGNESIUM ALLOY PROCESSING MATERIALS WITH LOW CYCLE FATIGUE LIFE IMPROVED BY PRE-STRAINING

(75) Inventors: Sung-Hyuk Park, Pohang-si (KR); Chong-Soo Lee, Pohang-si (KR); Seong-gu Hong, Daejeon (KR); Byoung-Ho Lee, Pohang-si (KR)

(73) Assignee: Postech Academy-Industry Foundation, Pohang-si, Gyeongsangbuk-do (KR)

( * ) Notice: Subject to any disclaimer, the term of this patent is extended or adjusted under 35 U.S.C. 154(b) by 0 days.

(21) Appl. No.: 13/384,441

(22) PCT Filed: Aug. 12, 2009

(86) PCT No.: PCT/KR2009/004505

§ 371 (c)(1), (2), (4) Date: Jan. 17, 2012

(87) PCT Pub. No.: WO2011/007920

PCT Pub. Date: Jan. 20, 2011

(65) Prior Publication Data

US 2012/0111081 A1 May 10, 2012

(30) Foreign Application Priority Data

Jul. 17, 2009 (KR) ..... 10-2009-0065438

(51) Int. Cl.

| | |
|---|---|
| ***C22F 1/06*** | (2006.01) |
| ***C22C 23/00*** | (2006.01) |
| ***B21D 9/00*** | (2006.01) |

(52) U.S. Cl.

USPC ..... 72/365.2; 148/667

(58) Field of Classification Search

USPC ..... 148/402, 420, 667; 72/360, 365, 72/365.2

See application file for complete search history.

(56) References Cited

U.S. PATENT DOCUMENTS

| | | | | |
|---|---|---|---|---|
| 3,841,921 | A * | 10/1974 | Shapiro et al. | 148/684 |
| 4,151,013 | A * | 4/1979 | Thompson et al. | 148/502 |
| 6,143,097 | A | 11/2000 | Fujita et al. | |
| 7,140,224 | B2 * | 11/2006 | Luo et al. | 72/369 |
| 7,879,165 | B2 * | 2/2011 | Mori et al. | 148/667 |
| 8,142,578 | B2 * | 3/2012 | Cantrel et al. | 148/667 |
| 2003/0084968 | A1 | 5/2003 | Bronfin et al. | |
| 2003/0129074 | A1 | 7/2003 | Bronfin et al. | |
| 2008/0279715 | A1 | 11/2008 | Mori et al. | |

FOREIGN PATENT DOCUMENTS

| | | |
|---|---|---|
| JP | 07-224344 | 8/1995 |
| KR | 10-2007-0114621 | 12/2007 |
| KR | 10-2008-0104721 | 12/2008 |

* cited by examiner

*Primary Examiner* — David B Jones
(74) *Attorney, Agent, or Firm* — Sherr & Jiang, PLLC

(57) ABSTRACT

The present invention relates to a method of manufacturing magnesium alloy processing materials capable of improving low cycle fatigue life. The manufacturing method for magnesium alloy processing materials with improved low cycle fatigue life comprises pre-straining a magnesium alloy processing material which is processed.

2 Claims, 3 Drawing Sheets

METHOD OF MANUFACTURING MAGNESIUM ALLOY PROCESSING MATERIALS WITH LOW CYCLE FATIGUE LIFE IMPROVED BY PRE-STRAINING

CROSS REFERENCE TO PRIOR APPLICATIONS

This application is a National Stage Patent Application of PCT International Patent Application No. PCT/KR2009/004505 (filed on Aug. 12, 2009) under 35 U.S.C. §371, which claims priority to Korean Patent Application No. 10-2009-0065438 (filed on Jul. 17, 2009), which are all hereby incorporated by reference in their entirety.

TECHNICAL FIELD

The present invention relates to a method of manufacturing a magnesium alloy processing material with low cycle fatigue life improved, and more particularly, to a method of manufacturing a magnesium alloy processing material, capable of improving low cycle fatigue life of the magnesium alloy processing material by changing a deformation mechanism occurring in an extruded or rolled material during fatigue behavior through pre-straining.

BACKGROUND ART

Magnesium (Mg) has a specific gravity of 1.74 g/cm$^3$, which is ⅔ of the specific gravity of aluminum and ⅕ of the specific gravity of steel. Magnesium is the lightest metal among structural metals currently used, and is an environmentally friendly material having an unlimited resource because magnesium has high specific strength and is easily recycled. Since magnesium is an eighth most abundant element on earth, accounting for about 2.7% of the earth's crust, and in particular, magnesium constitutes about 0.13% of seawater, magnesium may be considered as an infinitely available resource.

Use of magnesium has been gradually increased according to demands for lightweight transportation vehicles in consideration of the global environment and fuel economy efficiency, and thus the application of magnesium to 3Cs products such as a mobile phone and a notebook, continues to increase to meet the demands for lightness, thinness, shortness, and smallness, and electromagnetic wave shielding property. Accordingly, study on material processing of magnesium alloys has been very actively conducted in various fields such as military/defense, transportation, and 3Cs.

Since magnesium parts or facilities are used in a service environment where a repetitive load or deformation is applied, a magnesium alloy processing material should have excellent fatigue properties in order to be applicable to various fields with high reliability. However, solutions for the above are incomplete so far. In particular, when compared with aluminum (Al), which is a major competitive material as a lightweight material, magnesium has a problem in that its applicability is limited due to fatigue properties inferior to those of aluminum because of low fracture toughness and, especially, poor fatigue properties at a low cycle fatigue region.

Meanwhile, the related arts related to magnesium alloys are described below. Korean Patent Application Laid-open Publication No. 2007-0114621 discloses a technique of controlling a temperature of a rolling roll and a surface temperature of an alloy plate according to the content of aluminum present in a magnesium alloy in order to obtain a magnesium alloy plate having excellent plastic workability, e.g., press workability.

However, this patent is disadvantageous in that material applicability may be limited because Al content is limited to mass percentage, and is also problematic in that the surface temperature of the magnesium alloy plate should be increased.

Also, Korean Patent Application Laid-open Publication No. 2008-0104721 discloses a magnesium alloy having higher strength and toughness than typical magnesium alloy, in which the homogeneity of a microstructure is improved by preventing the segregation of magnesium alloy through the addition of manganese, zirconium, zinc, and copper. This patent still has disadvantages in that cost is inevitably increased due to the addition of expensive alloying elements and a processability problem after preparation of the alloy is not resolved yet.

In addition to the above-described patents, patents regarding magnesium alloys relate to a magnesium alloy composition system and a method of processing magnesium alloy, and most of applications for those patents have been led by Japan. However, it is very difficult to find out a technique for improving fatigue properties of a magnesium alloy.

DISCLOSURE

Technical Problem

An aspect of the invention provides a method of manufacturing a magnesium alloy processing material having improved low cycle fatigue life by using pre-straining in order to improve low cycle fatigue life of a magnesium alloy processing material having poor low cycle fatigue properties.

Technical Solution

According to an embodiment of the invention, there is provided a method of manufacturing a magnesium alloy processing material having improved low cycle fatigue life by using pre-straining, the method including pre-straining a magnesium alloy processing material which is processed.

Advantageous Effects

According to the present invention, low cycle fatigue life of a magnesium alloy processing material can be improved, thus expanding application fields of the magnesium alloy processing material and securing stability of parts by virtue of the improvement of fatigue properties. Therefore, the present invention can be used as a base technology for developing high value-added products and greatly contribute to securing intellectual property rights against developed countries.

BEST MODE

Figure 1:
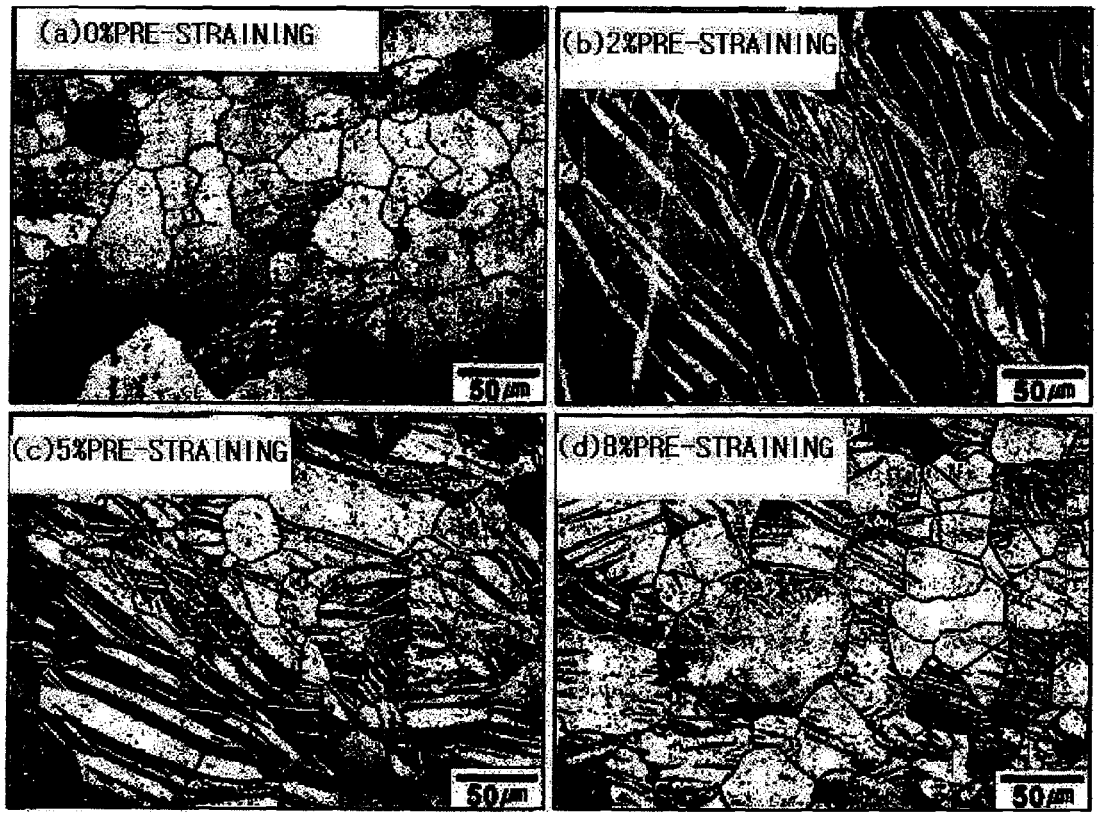
FIG. 1 is micrographs illustrating changes in microstructures according to pre-strain.

The present inventors recognized from the results of in-depth study that low cycle fatigue properties can be improved by lowering mean stress generated in a material through a change in deformation mechanism under repetitive behavior, by artificially causing a texture to be changed and twins to be generated in the material through pre-straining. Consequently, the present inventors have completed the present invention.

A texture having a preferred orientation with respect to a specific direction is formed in a magnesium alloy processing material which is manufactured through processing such as rolling or extrusion. In the texture, a basal plane of a hexagonal system is aligned parallel to a rolling direction when the magnesium alloy processing material is rolled; and the basal plane is aligned parallel to an extrusion direction when the magnesium alloy processing material is extruded.

Along with the texture generated by the processing such as rolling or extrusion, a twin is an important factor affecting room-temperature plastic deformation in a magnesium alloy having an insufficient slip system. Here, plastic deformations during tension and compression may vary with an orientation with respect to twinning.

That is, when compressive stress is applied in an extruding or rolling direction, generation of {10-12} extension twins is facilitated and thus, low yield strength and low strain hardening rate may be obtained through accommodation of deformation by twins. On the other hand, when tensile stress is applied in the extruding or rolling direction, stress conditions do not facilitate the generation of extension twins, and thus, high yield strength and high strain hardening rate may be obtained through accommodation of deformation by slip.

Fatigue behaviors in an extruding or rolling direction under a low cycle fatigue environment will be described in detail, in which tensile and compressive deformations are repeatedly applied. During compression, stress is generated in such a way of allowing {10-12} twins to be easily generated (c-axis tension mode), and therefore low tensile stress may be obtained by accommodating plastic deformation through {10-12} twinning. During tension, deformation is accommodated by detwinning the generated twins at an initial stage of deformation, and slip becomes a major deformation mode in the remaining stage of deformation so that high tensile stress may be obtained. Therefore, tensile mean stress is generated during the fatigue behavior, because tensile stress is larger than compressive stress. Since the tensile mean stress functions to reduce fatigue life by accelerating fatigue damage, the present invention attempts to provide a method of improving low cycle fatigue life by decreasing the mean stress.

For this purpose, the present invention provides a method of manufacturing a magnesium alloy processing material, capable of improving low cycle fatigue properties by pre-straining a processed magnesium alloy processing material in the processing direction. Rolling or extrusion may be applied to the processing for manufacturing the magnesium alloy processing material.

In the present invention, {10-12} twins are generated in a material through the pre-straining. When examining fatigue behavior after the pre-straining, an amount of {10-12} twins increases as pre-strain increases. Therefore, tensile stress gradually decreases during tension because a degree of accommodating deformation increases while twins generated by pre-straining are annihilated. On the contrary, during compression in a state where twins are generated, tensile stress gradually increases because twins are saturated at initial deformation to increase strain by slip. This allows mean stress generated during the fatigue behavior to gradually decrease as pre-strain increases, and thus low cycle fatigue life gradually increases. Resultantly, the low cycle fatigue life of the magnesium alloy processing material may be higher than that of a typical processing material by 50% maximally.

The pre-straining is performed in a strain range of 1% to 15%. When the strain is less than 1%, an improvement of fatigue life may not be expected because twinning by pre-straining is insignificant. Also, when the strain is greater than 15%, the improvement of fatigue life may not be expected anymore because twins are saturated during processing. It is preferable to perform pre-straining in a strain range of 1% to 10% in terms of economic factors.

That is, the present invention relates to a method of manufacturing a magnesium alloy processing material having improved low cycle fatigue life, in which the mean stress dominantly affecting fatigue life is decreased by changing a major deformation mechanism under repetitive behavior by generating twins through pre-straining of a magnesium alloy processing material after being processed in a processing direction such as rolling and extruding direction.

MODE FOR INVENTION

Hereinafter, the present invention will be described in more detail according to an embodiment. However, the present invention is not limited to the embodiment.

Embodiment

A rolled plate of AZ31 magnesium alloy having a composition of 3.6 wt % of aluminum (Al), 1.0 wt % of zinc (Zn), 0.5 wt % of manganese (Mn), and magnesium (Mg) as a remainder was subjected to pre-straining in a rolling direction, and microstructures thereof according to pre-strain are shown in FIG. 1.

It can be observed that twins did not exist in an initially rolled material which was not subjected to pre-straining (FIG. 1(*a*)), but twins (bright region) increased as the pre-strain increases (FIGS. 1(*b*), 1(*c*), and 1(*d*)).

Figure 2:
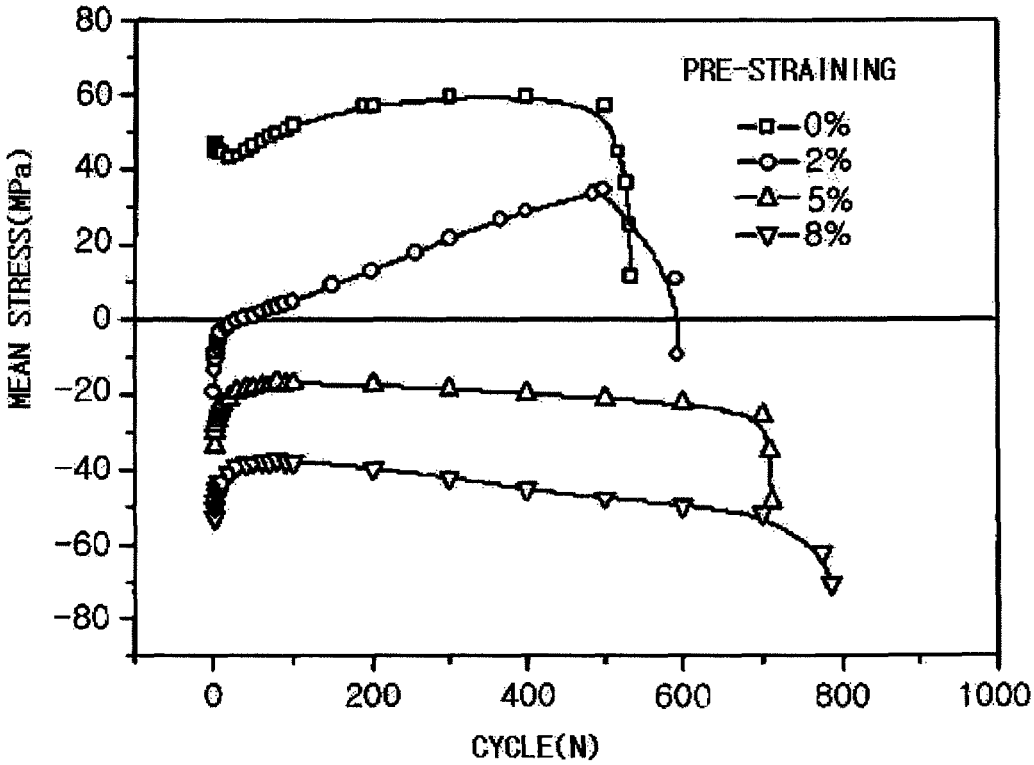
FIG. 2 is a graph illustrating changes in mean stress according to pre-strain.

Changes in mean stress generated during fatigue behavior after pre-straining were measured, and the results thereof are shown in FIG. 2. It can be understood that the more the pre-strain increased, the lower the curve was plotted. That is, it can be understood that the mean stress generated in a material during the fatigue behavior decreased according to the increase in the pre-strain.

Figure 3:
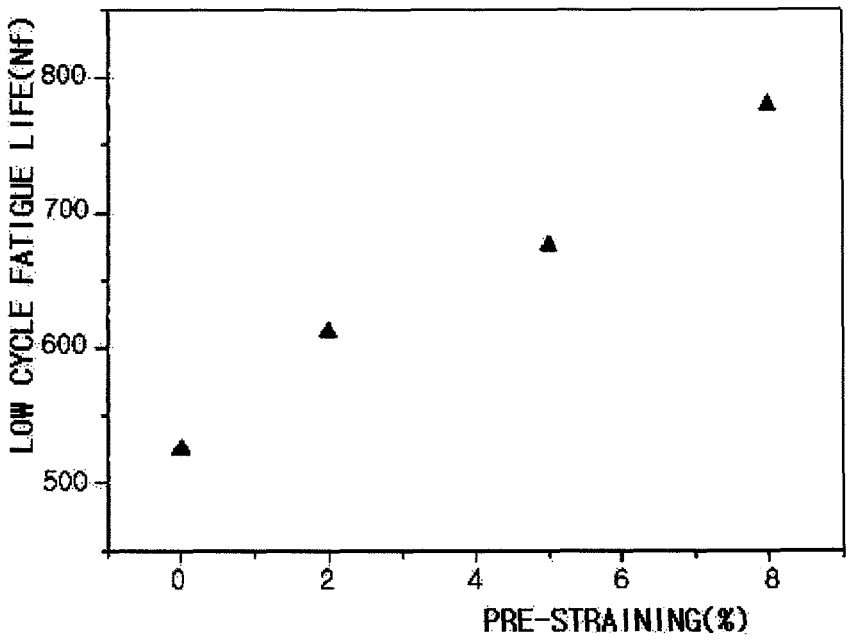
FIG. 3 is a graph illustrating changes in low cycle fatigue life according to pre-strain.

Also, low cycle fatigue life was measured according to pre-strain, and the results thereof are shown in FIG. 3. As shown in FIG. 3, low cycle fatigue life was increased due to the decrease in the mean stress according to the increase in the pre-strain. That is, it can be understood that fatigue life was higher than that of a processing material without compressive deformation by 50% maximally.

The invention claimed is:

1. A method of manufacturing a magnesium alloy processing material having improved low cycle fatigue life, the method comprising:

processing the magnesium alloy to form a texture in which a basal plane of a hexagonal system is arranged parallel to a processing direction; and changing the texture and forming {10-12} extension twins, by subjecting the magnesium alloy processing material with the texture to pre-straining in the processing direction at a strain ranging from 1% to 15%.

2. The method of claim 1, wherein the magnesium alloy includes 3.6 wt % of aluminum (Al), 1.0 wt % of zinc (Zn), 0.5 wt % of manganese (Mn), and magnesium (Mg) as a remainder.

* * * * *